United States Patent [19]

Pekovic

[11] Patent Number: 4,787,382

[45] Date of Patent: Nov. 29, 1988

[54] APPARATUS FOR ANAESTHETIZING AN ANIMAL

[75] Inventor: Drasko D. Pekovic, Dollard-des-Ormeaux, Canada

[73] Assignee: Soficorp Scientifique Inc., Dollard-des-Ormeaux, France

[21] Appl. No.: 77,460

[22] Filed: Jul. 24, 1987

[51] Int. Cl.[4] ..... A62B 18/06

[52] U.S. Cl. ..... 128/203.25; 119/15

[58] Field of Search ..... 128/203.25, 203.29, 128/205.26; 119/15, 160

[56] References Cited

U.S. PATENT DOCUMENTS

| | | | |
|---|---|---|---|
| 3,799,163 | 3/1974 | Heath | 128/205.26 |
| 4,181,129 | 1/1980 | Cameto et al. | 128/205.26 |
| 4,577,628 | 3/1986 | Hickmann | 128/205.26 |

FOREIGN PATENT DOCUMENTS

| | | | |
|---|---|---|---|
| 121795 | 10/1984 | European Pat. Off. | 119/15 |
| 1060180 | 12/1983 | U.S.S.R. | 119/15 |

*Primary Examiner*—Gerald A. Michalsky

*Attorney, Agent, or Firm*—Foley & Lardner, Schwartz, Jeffery, Schwaab, Mack, Blumenthal & Evans

[57] ABSTRACT

The apparatus is suitable to enable an animal to undergo surgery or the like. It comprises a base on which the animal is placed before being anaesthetized and a hollow bell type enclosure to be disposed over the base with the animal bound therewith. There is provided a supply for an anaesthetic substance to be introduced into the enclosure for anaesthetizing the animal and a control enabling to introduce the anaesthetic substance into the enclosure when the animal is to be anaesthetized and to stop the introduction when the anaesthetic substance is no longer required. An opening is provided in the enclosure which enables to place the animal with its head inside the enclosure thereby keeping it under anaesthetic conditions while its body lies outside the enclosure where a surgical operation or the like can take place.

18 Claims, 3 Drawing Sheets

APPARATUS FOR ANAESTHETIZING AN ANIMAL

BACKGROUND OF INVENTION (a) Field of the Invention

This invention relates to an apparatus for anaesthetizing animals. More particularly, the present invention is directed to a device which enables to anaesthetize and to keep an animal such as a laboratory mouse, rat, hamster, etc. under anaesthesia as surgery or the like treatment is being performed thereon.

(b) Description of Prior Art

It is well known that surgical operations or similar treatment are carried out in a routine manner, especially in experimental laboratories, on a variety of animals, such as rats or the like. Of course, these animals must be anaesthetized prior to surgery and this may often cause difficulties especially if the treatment lasts for some time where the duration of the anaesthesia should be strictly controlled. Ideally, there should be a method of anaesthetizing animals which is readily available and which should enable the scientist or technician who makes experiments on animals such as injections and surgery, to perform the anaesthesia under controlled conditions without requiring outside help. To my knowledge, such a method or a device enabling an easy, safe and controlled anaesthesia of an animal for surgery or the like treatment in a laboratory, is not known and certainly not readily available.

SUMMARY OF INVENTION

It is an object of the present invention to provide an apparatus for anaesthetizing animals which is safe and easy to operate and ensures controlled anaesthetic conditions.

It is another object of the present invention to provide an apparatus for anaesthetizing an animal and enabling the latter to undergo surgery or the like. The apparatus comprises a base on which the animal is placed before being anaesthetized, a hollow bell type enclosure to be disposed over the base with the animal bound therewith, means defining a supply for an anaesthetic substance to be introduced into the enclosure for anaesthetizing the animal, control means enabling to introduce the anaesthetic substance into the enclosure when the animal is to be anaesthetized and to stop the introduction when the anaesthetic substance is no longer required, opening means provided in the enclosure enabling to place the animal with its head inside the enclosure to keep it under anaesthetic conditions while its body lies outside the enclosure where a surgical operation or the like can take place.

BRIEF DESCRIPTION OF DRAWINGS

These and other objects of the present invention will be better understood with reference to the annexed drawings which are given only for the purpose of illustration without any intention to limit the invention thereto. In the drawings.

DESCRIPTION OF PREFERRED EMBODIMENTS

Figure 1:
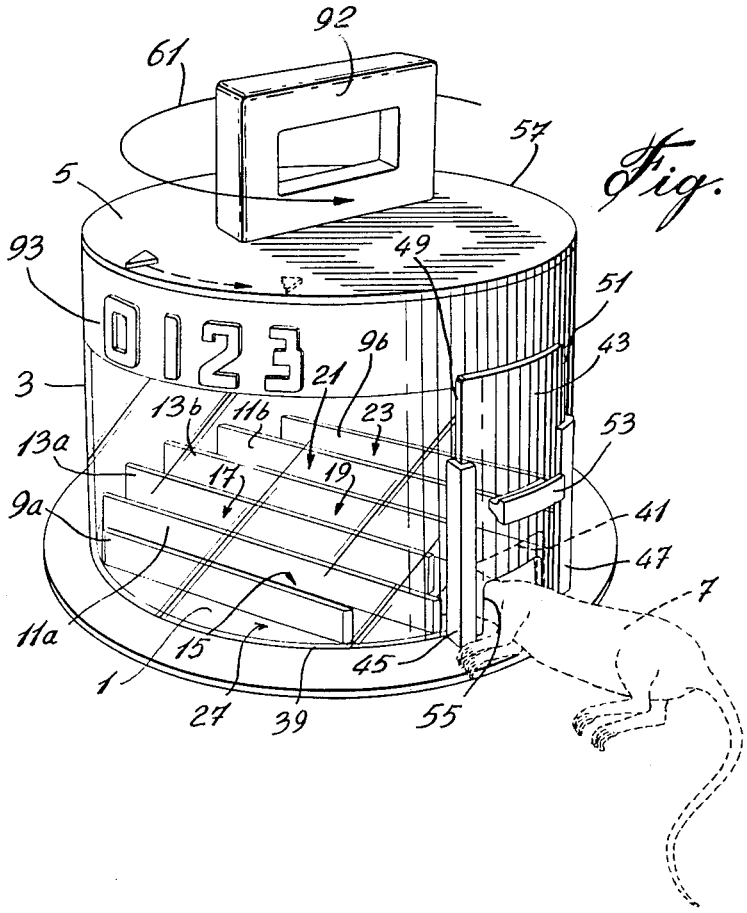
FIG. 1 is a perspective view of an apparatus according to the invention in operation with an animal under anaesthesia ready for a surgical operation.

Referring to the drawings, it will be seen that the apparatus which is illustrated essentially comprises a base 1, an enclosure 3, a removable cover 5 and a removable container 5*a* for material 6 to be used for anaesthesia. As particularly shown in FIG. 3, the base 1 is intended to be used for placing an animal 7 illustrated in dotted lines as indicated in FIG. 3 immediately before and during anaesthesia, but not when the animal 7 is undergoing a surgical treatment or the like.

Figure 3:
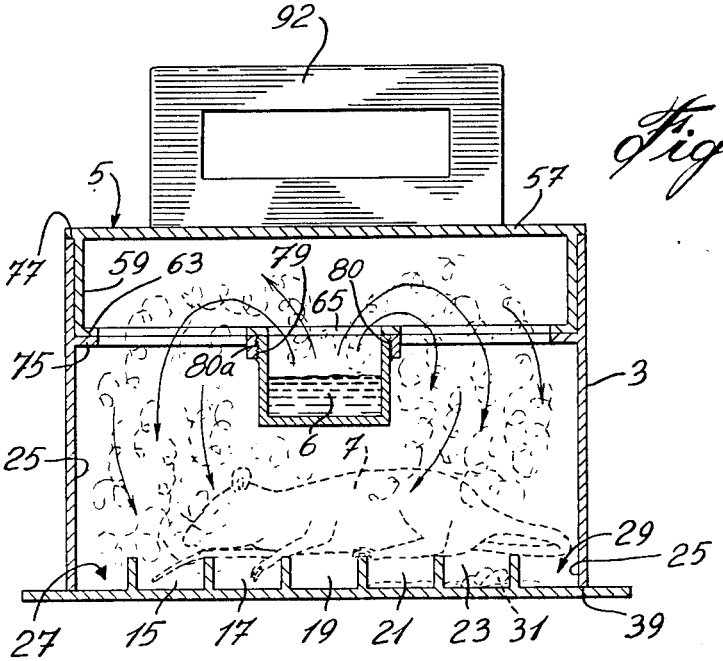
FIG. 3 is a vertical cross-section view of the apparatus illustrated in FIGS. 1 and 2 showing an animal being anaesthetized.

The hollow bell type enclosure 3 which will be described more in detail hereinafter, is designed to be disposed over the base 1 with the animal 7 bound by the enclosure, as shown in FIG. 3. The cover 5, which will also be described more in detail hereinafter, is intended to close the upper end of the enclosure 3. Finally, the container for substances 6 will be used for anaesthesia.

The base consists of a circular plate having a larger diameter than the enclosure 3 so as to easily place the enclosure 3 on the circular plate when an animal is intended to be anaesthetized. In addition, the base 1 constituted of a circular plate has disposed thereon a plurality of plates 9*a*, 9*b*, 11*a*, 11*b*, 13*a* and 13*b*, vertically mounted to be fixed on the base 1 in the manner illustrated in FIGS. 1, 3 and 5 of the drawings. The vertical plates can be fixed in known manner to the base or, if desired, they can be integrally molded as it is well known to those skilled in the art. In the model illustrated, the vertical plates 9*a*, 9*b*, 11*a*, 11*b*, 13*a* and 13*b* are parallel to one another so as to define a plurality of channels 15, 17, 19, 21, 23 as better illustrated in FIGS. 1 and 3. Additional channels are also provided between the vertical wall 25 of the enclosure 3 and the vertical plates 9*a*, 9*b*. These channels will be referred to by reference numerals 27 and 29.

It is well known indeed that as soon as the animal 7 will start to become anaesthetized, it will eliminate solid and liquid excretions 31, 33. By providing the vertical plates 9*a*, 9*b*, 11*a*, 11*b*, 13*a*, 13*b*, the animal 7 will be prevented from being soiled by the excretions 31, 33 and the base will easily be cleaned by merely spraying its surface with water.

Figure 5:
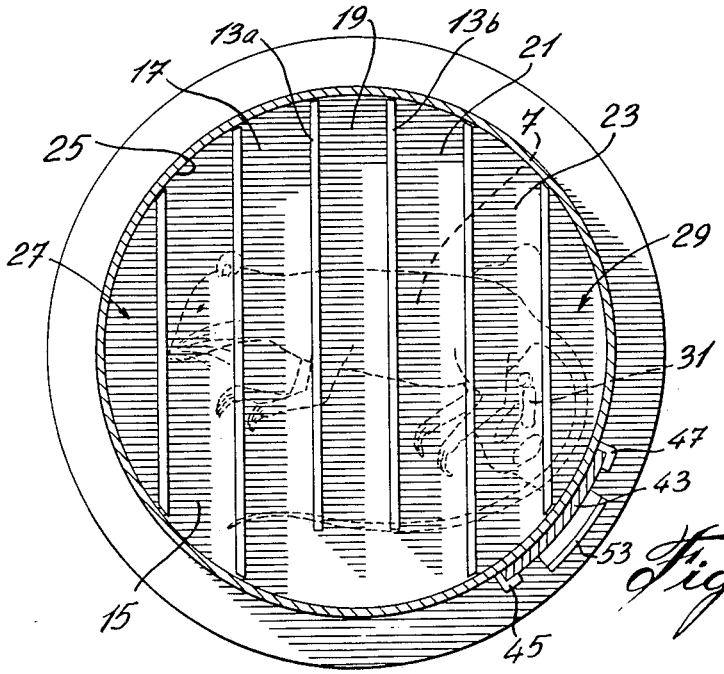
FIG. 5 is a cross-section view taken along line 5—5 of FIG. 2.

As shown in FIGS. 1 and 5, vertical plates 9*a*, 11*a*, 11*b* and 9*b* extend quite near the inner wall 25 of the enclosure 3 when the latter is disposed on the base 1. With respect to vertical plates 13*a*, 13*b*, it will be noted that one end is quite near the inner wall 25 as shown in FIG. 5 while the other ends 35, 37 respectively of vertical plates 13*a*, 13*b* terminate short of the vertical wall 25. The reason is that when it is desired to proceed to a surgical operation or another treatment of the same type on animal 7, it is merely necessary to place the animal 7 under anaesthesia in the position illustrated in FIG. 1 which enables the head of the animal to be placed on the circular plate 1 while the surgical operation or the like treatment takes place outside the apparatus.

As mentioned above, the hollow bell type enclosure 3 is cylindrical and the circular plate 1 has a larger area than that defined by the lower edge 39 of the enclosure 3. The reason is that in operation, the enclosure must rest entirely on the circular plate 1 in order to provide an atmosphere of anaesthetizing gas inside the enclosure when the animal 7 is being anaesthetized.

Referring again to the enclosure 3, it will be seen that it comprises an opening 41, which, in the present case is substantially rectangular but can of course be of any shape desired depending on the choice of design. The opening 41, as shown, is formed in the wall 25 of the cylindrical enclosure 3 at the lower edge thereof. To close this opening 41, there is provided a door 43 which will be described more in detail hereinafter. However, it should be mentioned now that this door 43 is provided to close the opening 41 when the animal 7 is inside the cylindrical enclosure 3 while being anesthetized.

Figure 4:
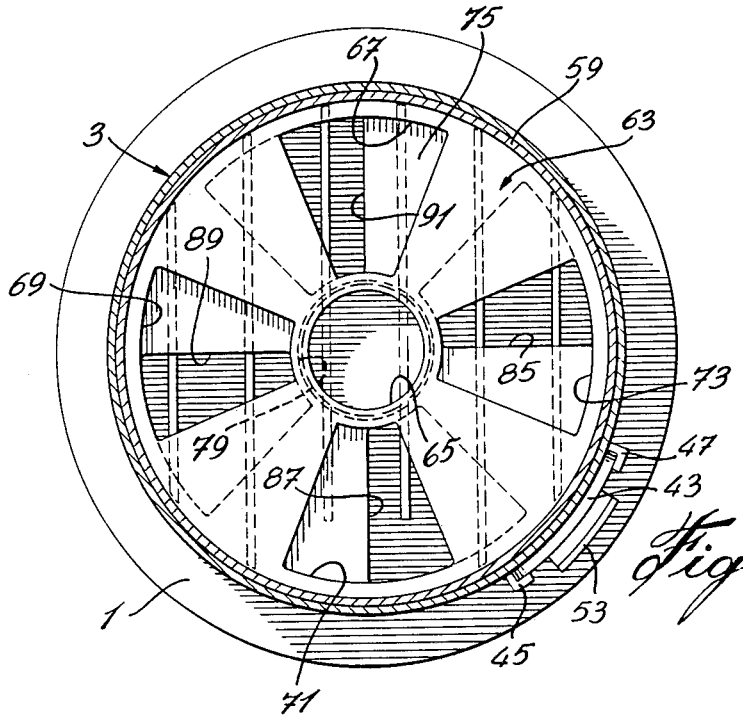
FIG. 4 is a cross-section view taken along line 4—4 of FIG. 2.

Referring now to FIGS. 1, 4 and 5, it will be seen that two slides 45,47 are mounted vertically on both sides of the opening 41. As particularly shown, these slides consist of L-shaped flange members which are fixed on the outer face of the cylindrical enclosure 3 in a manner well known to those skilled in the art, such as by gluing, or the like. These flanges could also be formed simultaneously by molding when preparing the enclosure 3. Returning now to door 43, as illustrated, it is slightly convex in order to enable it to follow the outer contour of the cylindrical enclosure. The door 43 has lateral edges 49,51 which are respectively received in the L-shaped flange type slides 45 and 47 for upward and downward movement of the door panel 43. In other words, the lateral edges 49,41 are slidably engaged by the flange members defining the slides 45,47. To facilitate the upward and downward siding movement of the door 43, the latter is provided with a knob 53, fixed in known manner on the outer face thereof. It is therefore easy to raise and lower the panel 43 by merely using the knob 53.

Figure 2:
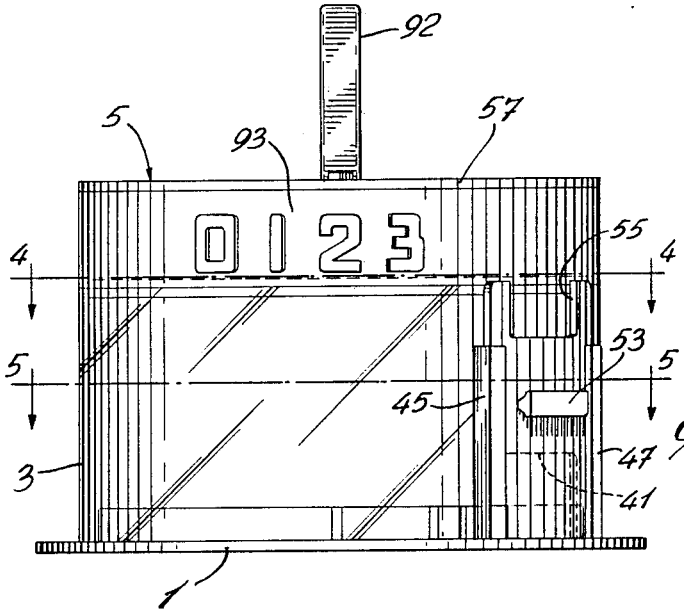
FIG. 2 is a side view of the same device.

In addition, an aperture 55, which, in the case illustrated, is slightly smaller than opening 41, is formed at one end of the panel 43. With this arrangement, it is possible to place the door 43 with the aperture 55 in lower position as shown in FIG. 1, so that both opening 41 and aperture 55 are exactly opposite one another when the surgical operation or the like takes place and the animal 7 has its head inside the cylindrical enclosure 3, as shown in FIG. 1. It will easily be realized that in this position, the aperture 55 surrounds the neck portion of the animal 7. If, on the other hand, it is required to proceed with the anaesthesia of the animal 7, the door panel 43 is in the position illustrated in FIG. 2. In other words, in order to completely close the opening 41, it is merely necessary to reverse the door panel 43 by completely sliding it out of the flange type slides 45,47 and to reverse it with the aperture 55 in the upper position as shown in FIG. 3. Then, the atmosphere inside the enclosure 3 is completely isolated and the animal can be anaesthetized by merely introducing an anaesthetic substance inside the enclosure 3, as will be described later.

As mentioned above, the apparatus according to the invention also includes as an essential component, a movable cover 5 which is used to close the cylindrical enclosure 3 at the upper end thereof. In addition, the removable cover is essential in its specific construction for controlling the anaesthetic conditions inside the enclosure 3.

The removable cover 5 consists of a flat circular member 57 which has the same diameter as the cylindrical enclosure 3. The cover 5 also comprises a circular collar 59 which is downwardly dependent from the flat circular member 57 and is shaped to fit snugly inside the cylindrical enclosure 3 at the top end of the latter, so as to enable the cover to rotate with respect to the inner wall 25 of the enclosure 3 in the direction illustrated by the arrow 61. At the lower edge of the circular collar 59, there is provided a transverse partition 63 which will now be described. This transverse partition has a circular opening 65 formed centrally thereof, and four windows 67, 69, 71 and 73 shaped as segments of annulus, which are radially distributed about the opening 65. The opening 65 and the windows 67, 69, 71 and 73 are intended to be used for controlling the amount of anaesthetic substances inside the enclosure as will be discussed later.

The particular construction of the cover 5, especially as regards the transverse partition 59, is intended to be used in conjunction with a second partition 75 which will now be described. Transverse partition 75 is formed in the upper portion of the cylindrical enclosure 3, short of the upper edge 77 thereof to be exactly engageable with the transverse partition 63. At the center of the transverse partition 75, there is an opening 79 which has the same diameter as the opening 65 formed in the transverse partition 63. The open cylindrical container 5*a* is mounted in the transverse partition 63 at the thread 80 and, as shown, is disposed centrally of the partitions 63, 75 to constitute a reservoir for the anaesthetic substance 6. Of course the opening 65 is formed with the thread 80 to engage threaded portion 80*a* of container 5*a*. Four segments of annulus 85, 87, 89 and 91 are regularly distributed around container 11. These segments of annulus 85, 87, 89 and 91 are identical to segments of annulus 67, 69, 71 and 73 and the two groups are superposable with one another.

Finally, the cover is provided with a handle 91 and a graduated scale 93. In practice, before proceeding to anaesthetize an animal 7, the container 81 is first filled to a desired level with an anaesthetic substance, such as ether. Then, the cover 5 is mounted in the enclosure 3 and by using handle 3, the cover is adjusted to position 0 of the scale 93 thereby arranging for the segments of annulus of the two partitions 63 and 75 to be completely offset which means that the anaesthetic substance is prevented from vaporizing into the enclosure 3 below the transverse partition 75. Then, by opening panel door 43 and placing the aperture 55 in the position illustrated in FIG. 2, an animal is placed on the vertical plates 9*a*, 9*b*, 11*a*, 11*a*, 13*a*, 13*b*. Following this, the cover is rotated in the direction of arrow 61 to a partial or full position of the scale 93 thereby partly or completely superimposing the segments of annulus as shown in FIG. 4 to enable the ether to vaporize and to circulate in the enclosure as shown in FIG. 3. Once the animal has been anaesthetized, the enclosure can be completely removed from the base 1, the animal 7 is placed in the position illustrated in FIG. 1, with the door in a position wherein the aperture 55 is opposite the opening 41 and the surgical operation can thereafter be carried out while continuously introducing ether in the enclosure in a controlled amount by adjusting the scale to any desired FIGS. 1, 2 or 3.

I claim:

1. An apparatus for anaesthetizing an animal and enabling the latter to undergo surgery or the like, comprising a base on which said animal is placed before being anaesthetized, a hollow bell type enclosure to be disposed over said base with said animal bound therewith, means defining a supply for an anaesthetic substance to be introduced into said enclosure for anaesthetizing said animal, control means enabling to introduce said anaesthetic substance into said enclosure when said animal is to be anaesthetized and to stop said introduction when said anaesthetic substance is no longer required, opening means provided in said enclosure enabling to place said animal with its head inside said enclosure to keep it under anaesthetic conditions while its body lies outside said enclosure where a surgical operation or the like can take place.

2. Apparatus according to claim 1, wherein said base comprises means enabling said base to receive excretions eliminated by said animal and to prevent same from being soiled therewith.

3. Apparatus according to claim 2, wherein said base is a circular plate, said means to receive said excretions consist of a plurality of vertically mounted plates fixedly disposed on said circular plate to define channels therebetween.

4. Apparatus according to claim 3, wherein said plates are disposed parallel to one another.

5. Apparatus according to claim 4, wherein said plates extend at least near the inner wall of said enclosure, except opposite said opening means where said plates terminate short thereof to enable the head of said animal to be placed on said circular plate while and surgical operation or the like takes place.

6. Apparatus according to claim 4, wherein said hollow bell type enclosure is cylindrical and the circular plate has a larger area than that defined by the lower edge of said enclosure, so that in operation the enclosure rests entirely on said circular plate.

7. Apparatus according to claim 6, which comprises a substantially rectangular opening formed in the wall of said cylindrical enclosure at the lower edge thereof, and a door to close said opening when said animal is in said cylindrical enclosure while being anaesthetized.

8. Apparatus according to claim 7, which comprises a pair of slides vertically mounted on both sides of said opening, said door consisting of a panel having lateral edges, said lateral edges being received in said slides for upward and downward movement of said panel.

9. Apparatus according to claim 8, wherein said panel is slightly convex to follow the outer contour of said cylindrical enclosure.

10. Apparatus according to claim 9, which comprises a knob mounted on the outer face of said panel to permit raising and lowering of said door when required.

11. Apparatus according to claim 10, which comprises an aperture formed at one end of said door panel, and means are provided to place said door with said aperture in lower position opposite said opening when said surgical operation or the like takes place and said animal has its head inside said cylindrical enclosure, said aperture then surrounding the neck of said animal, or alternately to completely close said opening by reversing said door panel with said aperture in upper position while said animal is being anaesthetized.

12. Apparatus according to claim 11, wherein said slides consist of flange members, and the lateral edges of said door panel are slidably engaged by said flange members.

13. Apparatus according to claim 12, which comprises a removable cover to close said cylindrical enclosure, said control means being associated with said removable cover.

14. Apparatus according to claim 13, wherein said means defining said supply for said anaesthetic substance is associated with said cylindrical enclosure.

15. Apparatus according to claim 14, which comprises a first transverse partition in the upper portion of said cylindrical enclosure, short of said upper edge thereof, and an open cylindrical container screwed in a first opening of said first transverse partition and disposed centrally thereto to constitute said means defining said supply of anaesthetic substance.

16. Apparatus according to claim 15, wherein said removable cover consists of a flat circular member of the same diameter as said cylindrical enclosure, a circular collar downwardly dependent from said flat circular member and shaped to fit substantially inside said cylindrical enclosure, at the top end thereof, in a rotatable fashion thereto, a second transverse partition mounted at the lower edge of said circular collar, and a second circular opening formed centrally of said second transverse portion exactly opposite said first opening, said first opening having a thread formed therein, said open cylindrical container having a threaded portion engageable by said thread, to enable a volatile anaesthetic substance to vaporize in space between said flat circular member and said second transverse partition, and window means in both said first and second transverse partitions superposable with one another to permit the vaporized anaesthetic substance to penetrate said enclosure to anaesthetize said animal.

17. Apparatus according to claim 16, wherein said window means are shaped as segments of annulus radially distributed about said open container in said first partitions and similar segments of annulus also radially distributed in said second partitions, a handle being provided in said cover to rotate same and partly or completely aligning said segments of annulus for introducing controlled quantities of vaporized anaesthetic substance in said enclosure and to completely offset said segments of annulus when no anaesthetic substance is required in said enclosure.

18. Apparatus according to claim 17, which comprises a scale marked on said enclosure to regulate the amount of anaesthetic substance introduced inside the enclosure.

* * * * *